US005226626A

United States Patent [19]

Driscoll

[11] Patent Number: 5,226,626

[45] Date of Patent: Jul. 13, 1993

[54] CEILING PANEL AND FAN CONSTRUCTION

[76] Inventor: Dennis F. Driscoll, 3616 Hwy. #33, Neptune, N.J. 07753

[21] Appl. No.: 783,525

[22] Filed: Oct. 28, 1991

[51] Int. Cl.[5] ..... B42F 13/00; G09F 7/18

[52] U.S. Cl. ..... 248/343; 52/39

[58] Field of Search ..... 52/475, 476, 484, 489, 52/490, 311, 312, 288, DIG. 8, 39; 416/5, 244 R; 248/343, 345

[56] References Cited

U.S. PATENT DOCUMENTS

| | | | |
|---|---|---|---|
| 2,382,456 | 8/1945 | Urbain | 52/475 |
| 3,031,042 | 4/1962 | Drackett | 52/475 |
| 3,460,299 | 8/1969 | Wilson | 52/475 |
| 3,546,842 | 12/1970 | Blum | 52/475 |
| 3,597,889 | 8/1971 | Lo Nigro | 248/343 |
| 4,122,762 | 10/1978 | Williams | 52/39 |
| 4,449,344 | 5/1984 | Dodich | 52/475 |
| 4,583,340 | 4/1986 | Sauer | 52/484 |
| 4,621,992 | 11/1986 | Angotti | 416/5 |
| 4,628,656 | 12/1986 | Menchetti et al. | 52/489 |
| 4,645,158 | 2/1987 | Manning | 248/343 |
| 4,679,375 | 7/1987 | Shirey | 52/475 |
| 4,866,904 | 9/1989 | Paul | 52/484 |
| 4,884,383 | 12/1989 | Rijnders | 52/489 |
| 4,885,889 | 12/1989 | Hemphill et al. | 52/484 |
| 4,991,373 | 2/1991 | Shaub | 52/489 |
| 5,044,103 | 9/1991 | Izenberg | 52/484 |
| 5,044,582 | 9/1991 | Walters | 248/343 |
| 5,077,951 | 1/1992 | Baker | 52/484 |

*Primary Examiner*—Carl D. Friedman
*Assistant Examiner*—Michele A. Van Patten
*Attorney, Agent, or Firm*—Leon Gilden

[57] ABSTRACT

Corner protector structure is mounted within each ceiling panel to provide for enhanced strength, durability, and appeal of a drop ceiling construction. The corner protectors in association with the ceiling panels are formed with a top wall spaced from and parallel a bottom wall to complementarily receive a ceiling panel therebetween, with reinforcing leg structure projecting beyond the top wall for reinforcement and enhanced appeal of the organization. A modification of the invention includes a fan assembly rotatably mounted medially of the reinforcing leg structure to enhance air distribution within a room containing the organization.

1 Claim, 3 Drawing Sheets 15
16
17
18
19
20

10
11
11a
11a
12
13
13
14
15
15
15
15
20
20
5
5

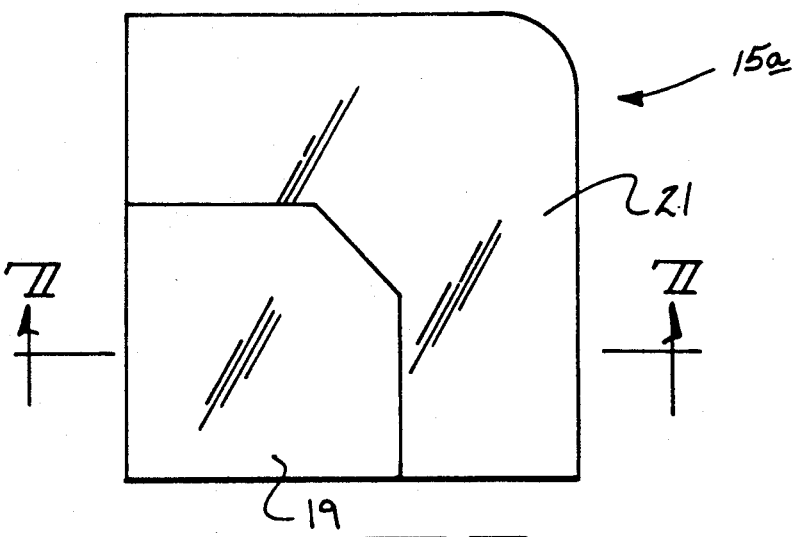
FIG 6
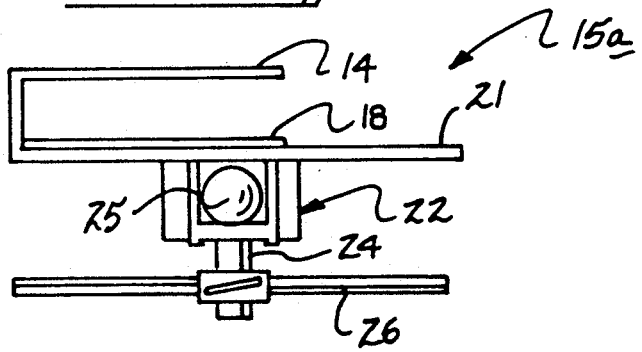
FIG 7
FIG 8
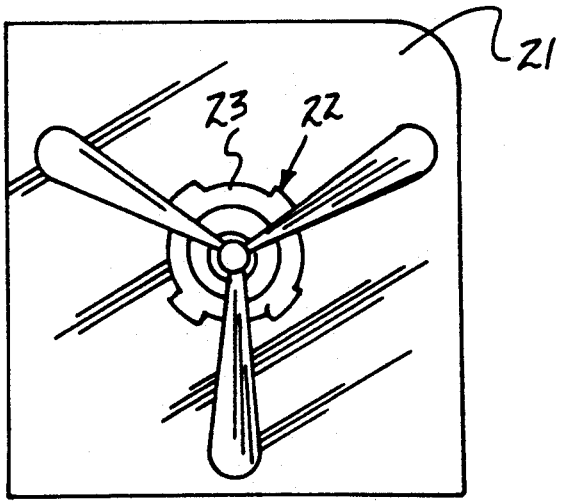

CEILING PANEL AND FAN CONSTRUCTION

BACKGROUND OF THE INVENTION

1. Field of the Invention

The field of invention relates to ceiling panel construction, and more particularly pertains to a new and improved ceiling panel construction wherein the same is arranged for corner protection structure within each ceiling panel to provide enhanced strength, durability, and appeal to a drop ceiling construction.

2. Description of the Prior Art

Various drop ceiling construction is available throughout the prior art wherein the typical drop ceiling panels are formed of a relatively frangible material mounted within a rectilinear framework. Prior art drop ceiling structure is exemplified in U.S. Pat. No. 4,164,011 to Sherwood utilizing various illumination members mounted exteriorly of the panel structure.

U.S. Pat. No. 4,693,924 to Kuper, et al. sets forth a decorative tile structure and its manner of construction.

U.S. Pat. No. 4,738,066 to Reed sets forth a further example of a drop ceiling construction.

As such, it may be appreciated that there continues to be a need for a new and improved ceiling panel construction as set forth by the instant invention which addresses both the problems of ease of use as well as effectiveness in construction in drop ceiling fabrication and in this respect, the present invention substantially fulfills this need.

SUMMARY OF THE INVENTION

In view of the foregoing disadvantages inherent in the known types of drop ceiling construction now present in the prior art, the present invention provides a ceiling panel construction wherein the same utilizes corner reinforcing members mounted to each corner portion of each panel of a drop ceiling organization. As such, the general purpose of the present invention, which will be described subsequently in greater detail, is to provide a new and improved ceiling panel construction which has all the advantages of the prior art ceiling panel construction and none of the disadvantages.

To attain this, the present invention provides a corner protector structure mounted within each ceiling panel to provide for enhanced strength, durability and appeal of a drop ceiling construction. The corner protectors in association with the ceiling panels are formed with a top wall spaced from and parallel a bottom wall to complementarily receive a ceiling panel therebetween, with reinforcing leg structure projecting beyond the top wall for reinforcement and enhanced appeal of the organization. A modification of the invention includes a fan assembly rotatably mounted medially of the reinforcing leg structure to enhance air distribution within a room containing the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling panel construction which has all the advantages of the prior art ceiling panel construction and none of the disadvantages.

It is another object of the present invention to provide a new and improved ceiling panel construction which may be easily and efficiently manufactured and marketed.

It is a further object of the present invention to provide a new and improved ceiling panel construction which is of a durable and reliable construction.

An even further object of the present invention is to provide a new and improved ceiling panel construction which is susceptible of a low cost of manufacture with regard to both materials and labor, and which accordingly is then susceptible of low prices of sale to the consuming public, thereby making such ceiling panel construction economically available to the buying public.

Still yet another object of the present invention is to provide a new and improved ceiling panel construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic bottom view of a modified corner protector structure.

FIG. 7 is an orthographic view, taken along the lines 7—7 of FIG. 6 in the direction indicated by the arrows.

FIG. 8 is an orthographic top view of the corner protector structure.

FIG. 9 is an isometric illustration of the invention in use.

DESCRIPTION OF THE PREFERRED EMBODIMENT

Figures 1, 2, 3, 4, 5:
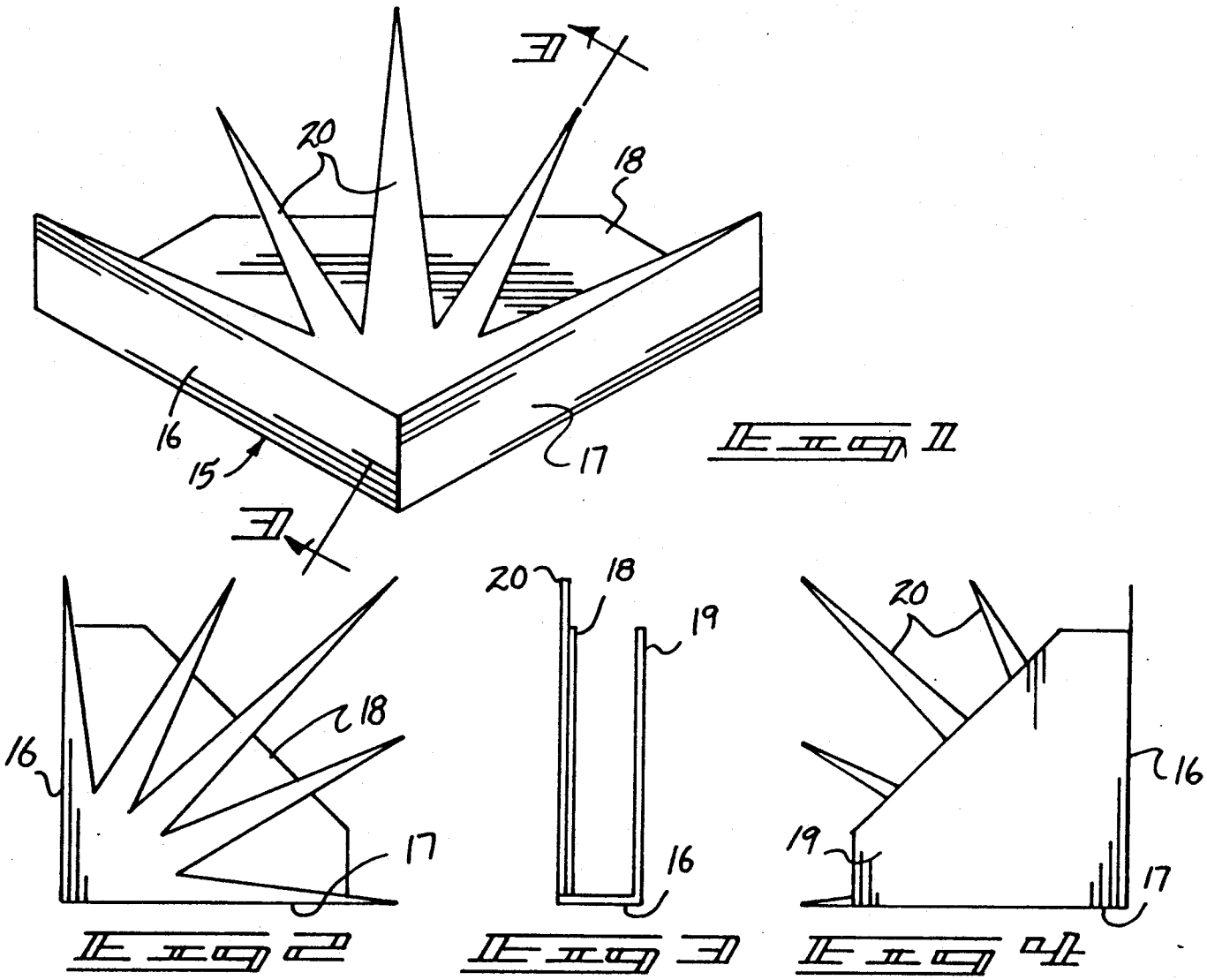
FIG. 1 is an isometric illustration of a corner protector utilized by the invention.
FIG. 2 is an orthographic top view of the corner panel construction.
FIG. 3 is an orthographic view, taken along the lines 3—3 of FIG. 1 in the direction indicated by the arrows.
FIG. 4 is an orthographic bottom view of the corner protector structure.
FIG. 5 is an orthographic cross-sectional view, taken along the lines 5—5 of FIG. 9 in the direction indicated by the arrows.
Figures 3, 4, 5:
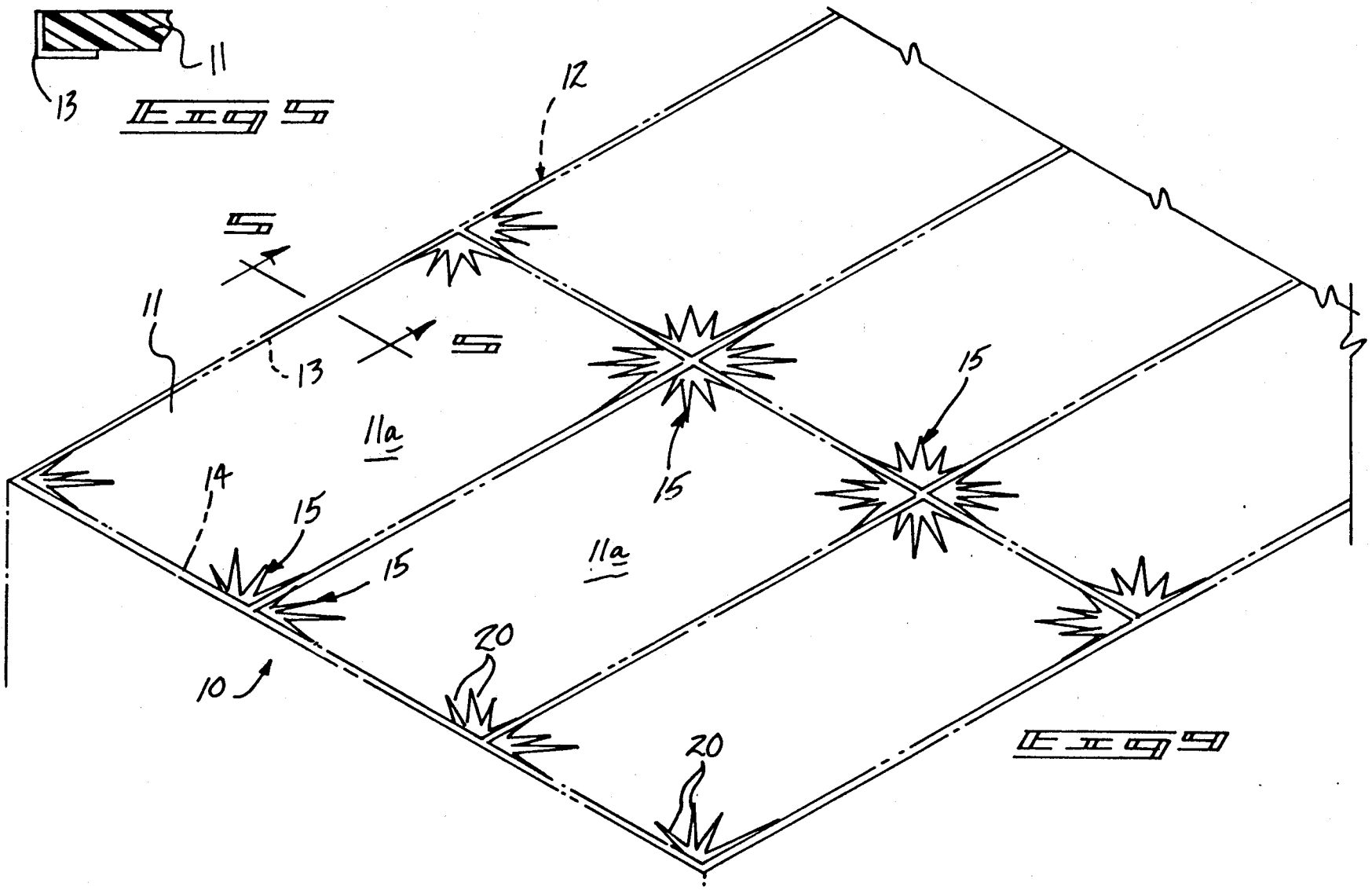

With reference now to the drawings, and in particular to FIGS. 1 to 9 thereof, a new and improved ceiling panel construction embodying the principles and concepts of the present invention and generally designated by the reference numeral 10 will be described.

Mores specifically, the ceiling panel construction 10 of the instant invention, as illustrated in the FIG. 9, illustrates a matrix of coplanar ceiling panels 11 mounted within a rectilinear framework 12, and is formed of equally spaced longitudinal "L" shaped supports 13 orthogonally intersecting parallel cross "L" shaped supports 14. FIG. 5 illustrates the positioning of a typical panel 11 on an associated support member.

Reinforcing corner supports utilized by the invention are illustrated and exemplified in the FIGS. 1–4 and 6–8 respectively. The corner supports 15 and 15*a* of the FIGS. 1 and 6 respectively are formed with a first side wall 16 orthogonally intersecting a second side wall 17, each side wall of an equal predetermined length. A support top wall 18 is arranged for integral and orthogonal intersection of the first and second side walls and is spaced parallel from a support bottom wall 19 a spacing equal to the predetermined thickness of each panel 11.

Top wall 18 is arranged for positioning to a bottom surface 11*a* of each panel in confronting relationship to a room, such as illustrated in FIG. 9. Projecting reinforcing legs 20 are contiguous with and extend beyond the top wall 18 to mask the structural reinforcing nature of the reinforcing legs 20 in a pleasing manner. Modified reinforcing leg plate structure 21, as illustrated in use in the modified panel corner support 15*a* of the FIGS. 6–8, that extends beyond the top wall 18 and is in contiguous parallel relationship thereto. A support cage 22 is positioned medially and fixedly to the reinforcing leg plate 21 extending orthogonally therebelow formed with a cage floor 23 parallel to the reinforcing plate 21 to rotatably and orthogonally receive a fan shaft 24 therethrough. An upper terminal end of the fan shaft 24 integrally mounts a bearing sphere 25 within the cage to rotatably mounted the fan shaft 24 within the cage, wherein a lower terminal end of the fan shaft 24 includes a plurality of fan blades 26 defined by a blade length substantially equal to or less than one-half the predetermined length of the reinforcing plate 21 to prevent intersection engagement of the blades 26 with adjacent blade structure or a vertical wall support surface within the room organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A ceiling panel and ban construction, comprising, a framework grid including a plurality of parallel equally spaced longitudinal supports, and a plurality of parallel cross supports, wherein the cross supports orthogonally intersect the longitudinal supports, and at least one ceiling panel mounted within the framework grid, the at least one ceiling panel including at least one reinforcing panel corner support mounted to a corner portion of the at least one ceiling panel, and the at least one corner support includes a first side wall of a first length orthogonally intersecting a second side wall of a length equal to the first length to define an L-shaped side wall, and a support top wall orthogonally intersecting an upper edge of the L-shaped side wall, and a support bottom wall orthogonally intersecting a lower edge of the L-shaped side wall, wherein the top wall is spaced from and parallel to the bottom wall a predetermined height substantially equal to a predetermined thickness defined by the at least one ceiling panel, and the top wall is mounted to a bottom surface of the at least one ceiling panel, and includes at least one reinforcing plate in contiguous securement to the top wall beyond the top wall, and a support cage medially and integrally mounted to the reinforcing plate extending therebelow, wherein the support plate includes a cage floor arranged parallel to and spaced from the reinforcing plate, and a fan shaft orthogonally and rotatably directed through the support cage floor, the fan shaft including a bearing sphere integrally mounted to an upper distal end of the fan shaft captured between the support cage floor and the reinforcing plate, and a lower distal end of the fan shaft includes a plurality of fan blades orthogonally mounted to and projecting exteriorly and radially relative to the fan shaft, wherein the reinforcing plate is defined by a plate predetermined length, and each fan blade is defined by a blade length less than one-half of the reinforcing plate predetermined length.

* * * * *